United States Patent [19]

Tani et al.

[11] Patent Number: 4,571,056

[45] Date of Patent: Feb. 18, 1986

[54] FIXING DEVICE

[75] Inventors: Tatsuo Tani, Urayasu; Yasunori Kawaishi, Chiba, both of Japan

[73] Assignee: Ricoh Company, Ltd., Japan

[21] Appl. No.: 590,721

[22] Filed: Mar. 19, 1984

[30] Foreign Application Priority Data

Mar. 18, 1983 [JP] Japan ..... 58-044362
Mar. 24, 1983 [JP] Japan ..... 58-049530

[51] Int. Cl.[4] ..... G03G 15/20

[52] U.S. Cl. ..... 355/3 FU; 355/3 SH; 219/216; 432/60

[58] Field of Search ..... 355/3 FU, 14 FU, 3 R, 355/3 SH, 30; 432/60; 219/216, 388, 469; 271/311, DIG. 2

[56] References Cited

U.S. PATENT DOCUMENTS 3,936,658 2/1976 Traister et al. ..... 219/216
3,998,584 12/1976 Wada et al. ..... 432/60
4,025,180 5/1977 Kurita et al. ..... 355/3 R
4,248,520 2/1981 Kurita et al. ..... 219/216 X
4,285,295 8/1981 Iwao et al. ..... 118/60
4,421,401 12/1983 Kagiura et al. ..... 355/3 SH X

FOREIGN PATENT DOCUMENTS 2001673 10/1970 Fed. Rep. of Germany .
0151979 9/1982 Japan ..... 355/3 FU

*Primary Examiner*—R. L. Moses
*Assistant Examiner*—J. Pendegrass
*Attorney, Agent, or Firm*—Guy W. Shoup

[57] ABSTRACT

A fixing device including a heating roller and a pressure applying roller maintained in pressing contact with each other and allowing a toner image bearing recording sheet to pass therebetween has a heat insulating structure enclosing at least a portion of the fixing device and a multiple wall structure for defining an air passage.

7 Claims, 4 Drawing Figures

FIXING DEVICE

BACKGROUND OF THE INVENTION

This invention relates to a fixing device of an electrophotographic copying apparatus and the like comprising a heating roller and a pressure applying roller forming a pair and maintained in rolling contact with each other to allow a toner image bearing recording sheet to pass therebetween to fix the toner image on the recording sheet.

A fixing device of the aforesaid type has been known and used widely with various types of recording apparatus including electrophotographic copying apparatus, printers, electrostatic recording apparatus, etc. In this type of fixing device, a toner image is fixed to a recording sheet mainly by the action of heat. As a result, elements of the fixing device, particularly the heating roller, are heated to a high temperature. If heating of the elements of the fixing device is left to run its course, the heat of the fixing device would be transferred to other devices of the recording apparatus and might exert injurous influences thereon. Particularly in a recording apparatus of the type in which the operator has the risk of touching the fixing device or devices located in the vicinity of the fixing device due to their structural relation, the accident of the operator having his or her hand burned by the heat of the heated fixing device might happen.

To avoid such accident, proposals have hitherto been made to surround the elements of the fixing device by a heat insulating material layer. However, the provision of a single heat insulating layer has been unable to achieve the desired results when the fixing device is operated for a prolonged period of time because the heat insulating layer is heated and its outer surface becomes very high in temperature. To avoid this trouble, proposals have been made to use a fan for blowing air toward the outer surface of the heat insulating material layer to lower the temperature of the outer surface thereof. However, the use of a fan has had the effect of scattering the heated air to the vicinity of the fixing device, thereby adversely affecting the devices in the vicinity of the fixing device.

In one type of fixing device, when a recording sheet passed between the heating roller and pressure applying roller adheres to the heating roller, the recording sheet is stripped off the heating roller by at least one stripping claw member in contact with the too heating roller. It is difficult, however, to avoid the trouble of a recording sheet jamming as the result of it being bitten by the heating roller and the forward end of the stripping claw member in this type of fixing device. This makes it nececessary to provide the fixing device with means for readily removing the recording sheet when jamming of the recording sheet occurs. Various proposals have been made and carried into practice to provide means for avoiding the occurrence of a recording sheet jam. For example, in one proposal, means is provided for moving the stripping claw member away from the feating roller together with elements located in its neighborhood to remove from between the heating roller and the stripping claw member moving away therefrom the recording sheet that has been stuck between the heating roller and the stripping claw member. When the stripping claw member is moved away from the heating roller, a sharp forward end of the stripping claw member is exposed from the fixing device to outside. Thus, there is the risk of the operator being injured when his hand inadvertently comes into contact with the forward end of the stripping claw member in removing the recording sheet stuck between the heating roller and the stripping claw member. To avoid this trouble, it is known to let the forward end of the stripping claw member remain facing downwardly without being exposed to outside when the stripping claw member is moved away from the heating roller. This type of fixing device of the prior art has suffered the disadvantge of being complex in construction and high in cost. A proposal has been made to move the stripping claw member away from the heating roller together with a heat insulating cover when a recording sheet jam occurs. However, it is impossible to obviate the aforesaid disadvantage by carrying this proposal into practice. Besides being unable to avoid the aforesaid disadvantage, moving the heat insulating cover away from the heating roller or opening the heat insulating cover exposes the heating roller to outside, with a result that the hand of the operator might be inadvertently brought into contact with the heating roller and suffer burns. Also, when the aforesaid proposal of moving the stripping claw member away from the heating roller together with elements located in its vicinity when a recording sheet jam occurs is carried into practice, it would be necessary to locally cut a large portion of the heat insulating cover to avoid the trouble of the heat insulating cover being interfered with by the retreating stripping claw member. However, this would result in a marked reduction in the effects achieved by the heat insulating cover in insulating heat.

SUMMARY OF THE INVENTION

This invention has been developed for the purpose of obviating the aforesaid disadvantages of the prior art. Accordingly, the invention has as one of its objects the provision of a fixing device capable avoiding dissipation of heat and a reduction in thermal efficiency.

Another object is to provide a fixing device capable of readily removing a recording sheet that has been stuck in a recording sheet jam without the risk of the operator being injured and yet capable of avoiding an appreciable rise in cost.

The aforesaid objects are accomplished by providing heat insulating means enclosing at least a portion of fixing rollers including a heating roller and a pressure applying roller, which has at least in one portion a double or multiple wall structure to define an air passage having an inlet located in the vicinity of an entrance and/or an exit of the fixing roller. The heat insulating means including a portion which is movable and has at least one stripping claw member connected thereto.

Additional and other objects, features and advantages of the invention will become apparent from the description set forth hereinafter when considered in conjunction with the accompanying drawings.

DESCRIPTION OF THE PREFERRED EMBODIMENTS

The fixing device according to the invention can be incorporated in various types of recording apparatus. The invention as incorporated in an electrophotographic copying apparatus of the toner image transfer-printing type in which images can be printed on both sides of a recording sheet will not be described by referring to embodiments shown in the accompanying drawings.

Figure 1:
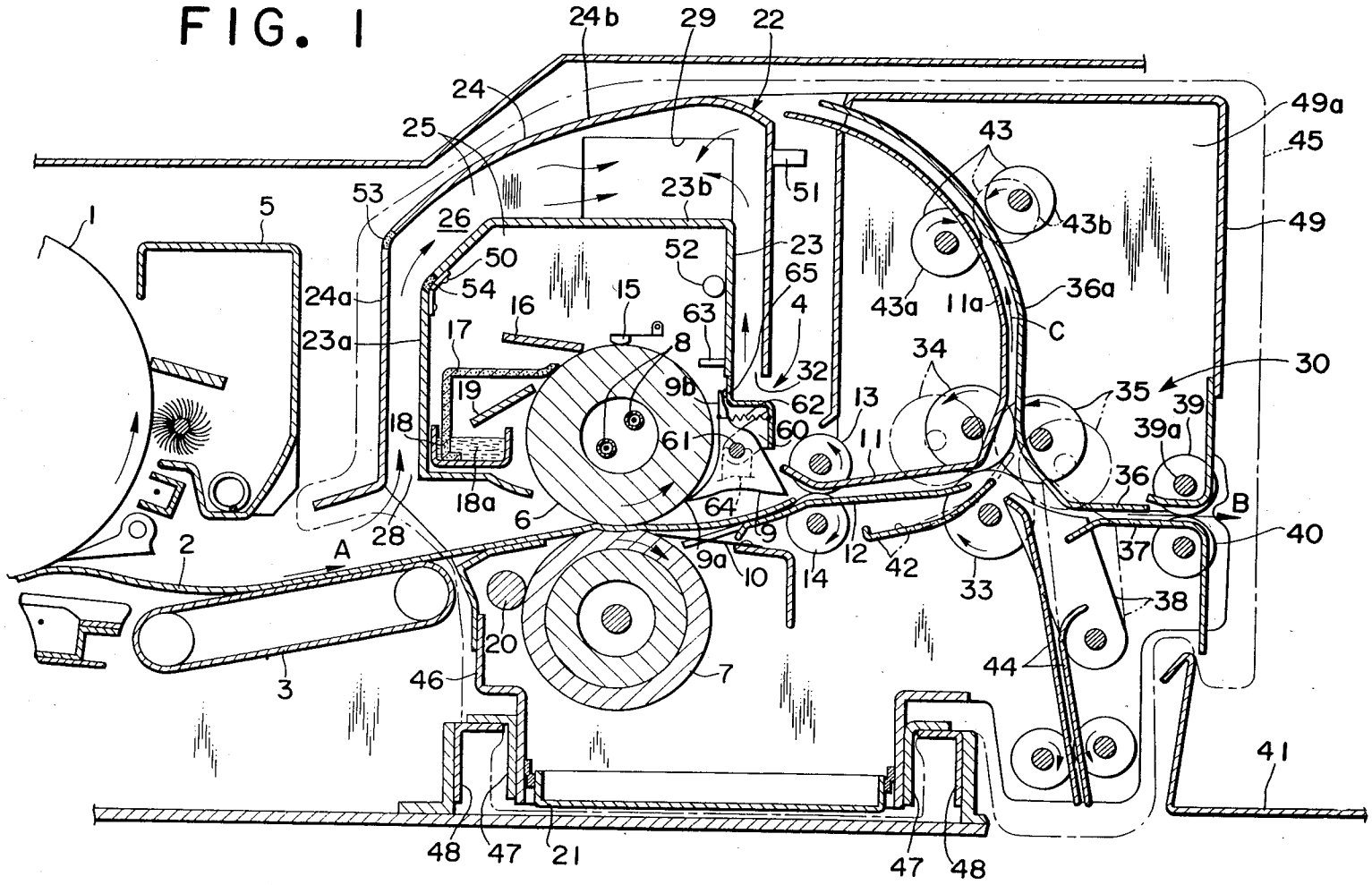
FIG. 1 is a fragmentary sectional view of an electrophotographic copying apparatus incorporating therein the fixing device comprising one embodiment of the invention.

Referring to FIG. 1, a photosensitive drum 1 is driven for rotation in a counterclockwise direction and a toner image is formed on its surface by a latent image forming device and a developing device, not shown. The toner image on the surface of the photosensitive member 1 is printed by transfer-printing on the surface of a recording sheet 2 fed to a transfer-printing station, and the toner image bearing recording sheet 2 is separated from the photosensitive drum 1 and conveyed by a conveyor belt 3 in the direction of an arrow A, to a fixing device 4 to have the toner image fixed to the surface of the recording sheet 2. After the toner image is printed from the photosensitive drum 1 to the recording sheet 2, a portion of the surface of the photosensitive drum 1 on which the toner image was formed is cleaned by a cleaning device 5 to have residual toner removed therefrom.

The fixing device 4 comprises a heating roller 6 having an axis extending perpendicular to the plane of FIG. 1, and a pressure applying roller parallel to the heating roller 6 and forming a pair therewith. The two rollers 6 and 7 are maintained in rolling engagement while in pressing engagement with each other. Heaters 8 are built in the heating roller 6 for heating the heating roller 6. In the embodiment shown in FIG. 1, the pressure applying roller 7 is provided with no heaters. However, a heater or heaters may be built in the pressure applying roller 7 to directly heat the pressure applying roller 7.

The heating roller 6 is driven for rotation by a drive, not shown, for rotation in a counterclockwise direction, and the pressure applying roller 7 is rotated in a clockwise direction. The recording sheet 2 on which a toner image is printed is fed between the heating roller 6 and pressure applying roller 7 and passed therebetween. At this time, the toner image on the recording sheet 2 is fixed to the surface of the recording sheet 2 mainly by the heat of the heating roller 6 heated by the heaters 8. After the fixing operation is finished, the recording sheet 2 is stripped off the roller 6 by one or a plurality of stripping claws 9 subseqnently to be described in detail when a leading end of the recording sheet 2 adheres to the heating roller 6, and stripped off the roller 7 by at least one stripping claw 10 located beneath the claws 9 when a leading end of the recording sheet 2 is brought into intimate contact with the periphery of the roller 7. The recording sheet 2 stripped off the rollers 6 and 7 after completion of the fixing operation is discharged from the fixing device 4 and guided by an upper guide plate 11 and a lower guide plate 12 and conveyed by conveyor rollers 13 and 14 rotating in the direction of arrows.

A thermistor 15 for monitoring the temperatures of the heating roller 6, a roller cleaning blade 16 for cleaning the surface of the heating roller 6 to clear it of the residual toner, an applying felt 17 for applying to the surface of the heating roller 6 a parting agent 18*a* supplied from a tank 18 and a metering blade 19 for uniformly spreading the parting agent applied to the peripheral surface of the roller 6 are arranged in the indicated order along the periphery of the heating roller 6. A cleaning roller 20 for cleaning the peripheral surface of the pressure applying roller 7, and an oil pan 21 for receiving the parting agent that might drop from the surfaces of the rollers 6 and 7 are located along the periphery of the pressure applying roller 7. These elements are known and their detailed description will be omitted.

As described hereinabove, fixing the toner image to the surface of the recording sheet 2 is mainly effected by the heat of the heating roller 6. Thus, the fixing device 4 is heated to a high temperature. In the embodiment shown and described hereinabove, the heaters 8 are only provided to the heating roller 6, so that the peripheral of the roller 6 becomes very high in timperature. If the heat of the heating roller 6 is allowed to be freely dissipated from the surface of the roller 6, all the elements located in the vicinity of the roller 6 would be adversely affected by the heat. For example, although influences exerted by heat on the photosensitive member 1 may vary depending on the material forming it, the sensitivity of the photosensitive drum 1 is generally reduced when its temperature rises to about 50° C., resulting in a shorter service life. The toner recovered from the photosensitive drum 1 is contained in the interior of the cleaning device 5. The toner usually has a property such that it is softened when heated to a temperature of about 100° C. Thus, if heat is directly given from the fixing device 4 to the cleaning device 5, there would be the risk of the toner being melted and caused to adhere to the cleaning device 5 by the heat of friction combined with the heat from the heating roller 6. Moreover, if heat is allowed to be dissipated freely from the heating roller 6, a large amount of heat would be lost. To obviate or diminish these disadvantages of the prior art, the invention provides heat insulating means 22 to the fixing device. The heat insulating means 22 according to the invention comprises a first heat insulating member 23 enclosing an upper portion of the outer periphery of the heating roller 6 at which the temperature rises to a particularly high level, and a second heat insulating member 24 located outwardly of the first heat insulating member 23. The two heat insulating members 23 and 24 are spaced apart from each other a predetermined distance. Side plates 25 are attached to ends of each of the two heat insulating members 23 and 24 as viewed perpendicularly to the plane of FIG. 1 (only one side plate of each heat insulating member is shown in FIG. 1). Thus, the region above the outer periphery of the heating roller 6 is enclosed by the first heat insulating member 23 and its two side plates 25, and an air passage 26 is defined between the first and second heat insulating members 23 and 24 and their two side plates 25 to allow air to flow therethrough as presently to be described. In the embodiment shown and described hereinabove, an air inlet 28 of the air passage 26 is located in a recording sheet entrance region 27 through which the recording sheet 2 is introduced into a nip between the heating roller 6 and pressure applying roller 7. An air outlet 29 is formed at one of the side plates 25 of the upper heat insulating member 22 and connected to suction means, such as a blower, not shown, to draw air by suction from the air passage 26. Preferably, the side plates 25 are formed of heat insulating material or have a coat of heat insulating material applied thereto.

The region above the outer periphery of the heating roller 6 is enclosed by the first heat insulating member 23 and the side plates 25 as described heeinabove, so that release of the heat from the heating roller 6 to outside the fixing device 4 can be avoided. Thus, a thermal loss can be avoided. Action of the blower described hereinabove allows air to be introduced into the air passage 26 through the air inlet 28 and discharged from the air passage 26 through the air outlet 29. This is conducive to prevention of the heat insulating members 23 and 24 from being overheated when the fixing device 4 is operated continuously over a prolonged period of time. Even if the outer surface of the first heat insulating member 28 is heated to a high temperature, the air flowing in the air passage 26 has the effect of preventing the second heat insulating member 24 from being heated to a high temperature. The results achieved in avoiding a rise in temperature by an air current in the air passage 26 may vary depending on the velocity of the air current. If the velocity is too high, too much heat would be dissipated from the fixing device 4, thereby increasing the heat loss. Conversely, if the velocity is too low, no satisfactory heat insulating effects could be achieved. It is desirable, therefore, that a suitable velocity be selected by reconciling the requirements which are contradictory to each other.

By the aforesaid heat insulating effects achieved by the heat insulating means according to the invention, the disadvantage of the prior art that the elements located in the vicinity of the fixing device 4 are heated to a high temperature is obviated. It will be appreciated that full realization of the advantage offered by the provision of the heat insulating means stems from the provision of a double wall structure to the heat insulating means. Cooling of the heat insulating member by an air current produced by a fan is known. However, in the prior art, the air current is applied to the outer surface of a heat insulating member which has a single wall structure, and this arrangement has produced a disadvantage in that the air heated by the heat insulating member is blown against other elements. Even if the heat insulating means is provided with a double wall structure by using the first and second heat insulating members 23 and 24, it would be impossible to seal the entrance region 27 of the rollers 6 and 7. Therefore, heat might leak through the entrance region 27 from the fixing device 4 even if the heat insulating means is provided with a double wall structure and elements in the vicinity of the fixing device 4 might be affected by this heat. However, in the embodiment shown and described hereinabove, the air inlet 28 of the air passage 26 is located in the entrance zone 27 of the rollers 6 and 7. By virtue of this arrangement, the heat is prevented from escaping from the fixing device 4 through the entrance region 27, and in addition air flows from outside into the entrance region 27 from outside, thereby avoiding heating the elements in the vicinity of the fixing device 4.

In the embodiment shown and described hereinabove, a recording sheet inverting device 30 for controlling the direction in which the recording sheet released from the fixing device 4 is delivered is located downstream of the fixing device 4 with respect to the direction in which the recording sheets are conveyed. As presently to be described, the inverting device 30 and parts in the vicinity thereof are preferably prevented from being heated by heat dissipated from the fixing device 4 to a high temperature. However, it is impossible to close an exit region 31 of the rollers 6 and 7 because recording sheets 2 released from the rollers 6 and 7 should be discharged from the fixing device 4. Thus, the heat of the fixing device 4 might be released to outside through the exit region 31, thereby heating the inverting device 30. To avoid this disadvantage, the embodiment shown and described hereinabove comprises a second air inlet 32 of the air passage 26 in the exit region 31 of the rollers 6 and 7 for allowing air to enter the air passage 26 through the second air inlet 32. Thus, the inverting device 30 and the parts located in its vicinity are prevented from being heated to a high temperature, in the same manner as the parts in the vicinity of the first air inlet 28 are prevented from being heated to a high temperature.

The inverting device 30 is not in itself indispensable to the invention. However, to enable the invention to be thorougly understood, a construction ancillary to the fixing device 4 will be described briefly.

Referring to FIG. 1, a drive roller 33 rotating in a clockwise direction is maintained in engagement with a first driven roller 34 and a second driven roller 35 rotating in a counterclockwise direction.

When a recording sheet released from the fixing device 4 is to be immediately ejected from the copying apparatus to outside, the first and second drive rollers 34 and 35 are disposed in solid line positions shown in FIG. 1 and the recording sheet 2 is conveyed in the direction of an arrow B while being held between the drive roller 33 on one hand and the driven rollers 34 and 35 on the other, guided by upper and lower guide plates 36 and 37 and an upper guide surface of a movable guide member 38 and ejected by recording sheet ejecting rollers 39 and 40 on to a stacker 41 disposed outside the copying apparatus.

When it is desired to invert or place the recording sheet 2 upside down before it is ejected from the copying apparatus to outside for the purpose of arranging recording sheet in an orderly manner when placed on the stacker 41, the driven rollers 34 and 35 are moved away from each other to phantom line positions shown in FIG. 1. At the same time, a movable guide plate 42 which was in a solid line position until then is moved to a phantom line position. When the leading end of the copy sheet 2 reaches the inverting device 30, the recording sheet 2 is moved upwardly in the direction of an arrow C by the driven rollers 34 and 35 in the phantom line positions while being guided by the movable guide plate 42. The recording sheet 2 is guided by guide plates 11*a* and 36*a* which are connected to the upper guide plates 11 and 36 respectively and have a pair of return rollers 43 mounted in suitable positions thereon. The return rollers 43*a* and 43*b* are supported for movement into and out of engagement with each other. The roller 43 which is fixed is driven for rotation in a direction in which the recording sheet is moved in a reverse direction while the roller 43*b* is freely rotatable. Thus, when a recording sheet is held between the return rollers 43*a* and 43*b*, the recording sheet is moved in the reverse direction. When the trailing end of the recording sheet clears a nip between the drive roller 33 and the first driven roller 34, the return rollers 43*a* and 43*b* which were out of engagement with each other until then are brought into contact with each other through the recording sheet and the movable guide plate 42 returns to the solid line position. Thus, the recording sheet is moved in a direction opposite to the direction indicated by the arrow C and held between the second driven roller 35 and the drive roller 33 and ejected to outside from the copying apparatus while being guided by the guide surface of the movable guide member 38 and the upper and lower guide plates 36 and 37. When the recording sheet is ejected on to the stacker 41, it is placed upside down on the stacker 41.

If the movable guide member 38 is moved to a phantom line position when the pair of return rollers 43 are brought into contact with each other through the recording sheet 2, then the recording sheet is moved downwardly while being guided by a pair of guide plates 44, to be returned to a transfer-printing station in which a toner image is printed by transfer-printing on a surface of the recording sheet opposite the surface thereof on which the toner image was printed previously. The toner image thus printed is fixed by the fixing device 4 to the surface of the, thereby finishing the operation of printing toner images on opposite surfaces of the same recording sheet.

If the movable guide plate 42, movable guide plate 38 and first and second driven rollers 34 and 35 are moved to the solid line position, phantom line position and solid line positions respectively, it is possible to directly delivered to the guide plates 44 below the inverting device 30 the recording sheet 2 that is released from the fixing device 4. By feeding the recording sheet 2 to the photosensitive drum 1 again, it is possible to print another toner image on the same surface as a toner image has been printed previously, to enable the two toner images to be integrated into a composite toner image.

When a recording sheet conveyed through the fixing device 4 and inverting device 30 is stuck in the path of travel, it is necessary that the recording sheet be removed as soon as possible to avoid a recording sheet jam. To this end, the fixing device 4 and inverting device 30 are formed into a unit 45, as indicated by a phantom line surrounding the two devices 4 and 30, which can be inserted into and withdrawn from the main body of the copying apparatus. More specifically, the unit 45 is supported by a support 46 as shown in FIG. 1 which in turn is supported on guide rails 47 slidably placed on fixed guide rails 48 secured to the main body of the copying apparatus for movement in a direction perpendicular to the plane of FIG. 1 to enable the unit 45 to be withdrawn from the main body of the copying apparatus in a direction upwardly away from the plane of FIG. 1.

Figure 2:
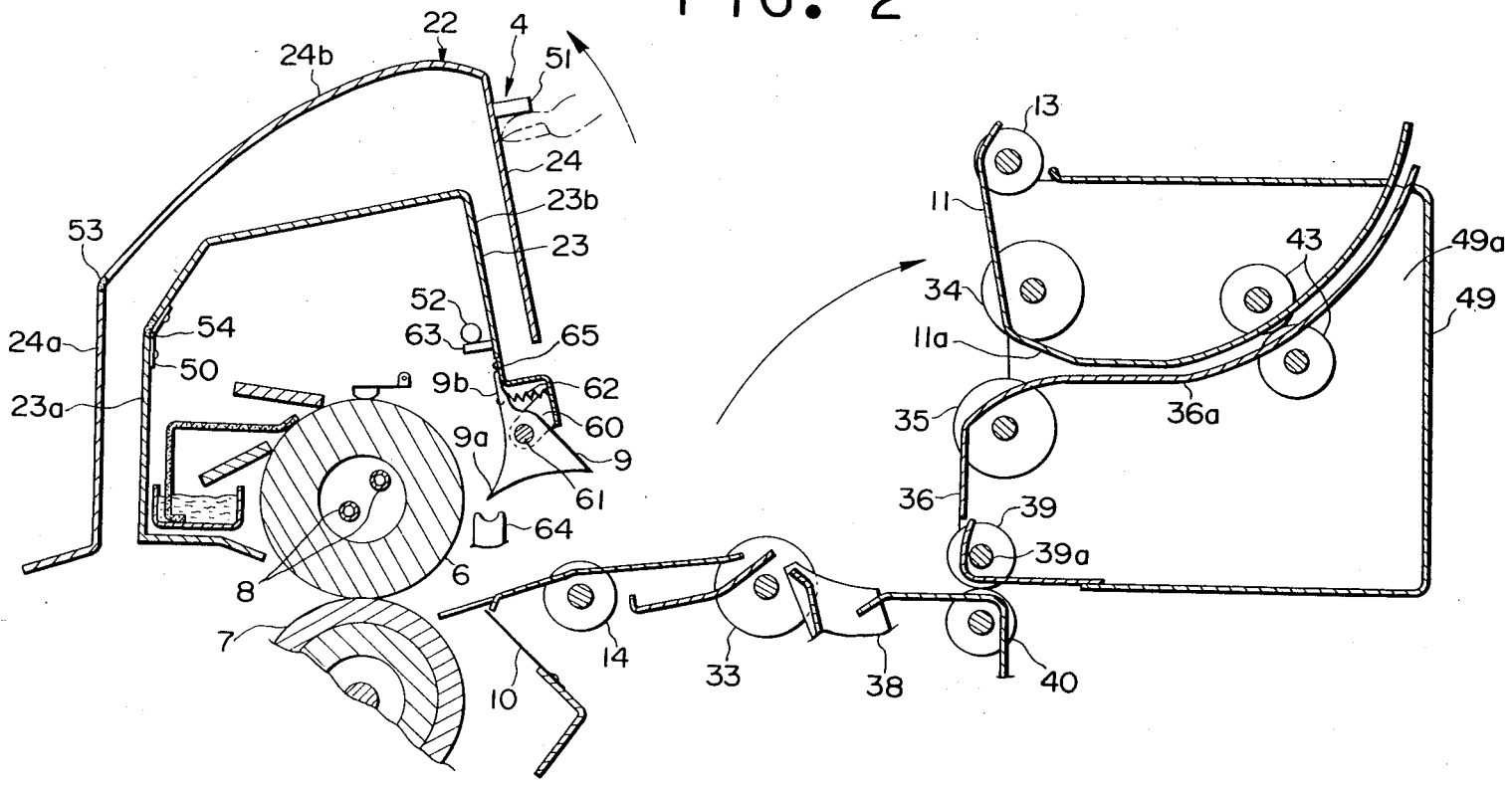
FIG. 2 is a sectional view of the vicinity of the fixing device shown in FIG. 1, showing the manner in which a recording sheet in a jam is removed.

The provision of the fixing device 4 and inverting device 30 as the unit 45 offers the following advantage. Assume that a recording sheet is stuck midway between the two devices 4 and 30. If one of the devices 4 and 30 is withdrawn, the jammed sheet could not be withdrawn or might be torn apart if forcibly withdrawn. In the embodiment shown and described hereinabove, the rollers 13, 34, 35 and 43 and the guide plates 11, **11*a* 36 and 36*a* are supported by a side plate 49*a* of a cover 49 for the inverting device 30, and the cover 49 can move about a shaft 39*a* of the roller 39 as shown in FIG. 2. Thus, if the cover 49 is moved as shown in FIG. 2 after the unit 45 is withdrawn from the main body of the copying apparatus, it is possible to readily remove from the inverting device 30 the recording sheet stuck therein. When the recording sheet is removed from the inverting device 30, the operator might touch the inverting device 30 and other elements in its vicinity. If they were heated to a high temperature, the operator might suffer burns. However, as described hereinabove, the fixing device 4 is provided with the heat insulating means 22 of the double wall structure and the air inlet 32 of the air passage 26 is located in the exit region 31 of the fixing device. By virtue of these features, the inverting device 30** and the elements in its vicinity are prevented from being heated to a high temperature, thereby enabling the operator to withdraw a recording sheet without any trouble.

In the embodiment shown and described hereinabove, a recording sheet can be readily withdrawn from the fixing device 4 when it is stuck therein. The first and second heat insulating members 23 and 24 are split into a fixed portion **23*a* and a movable portion 23*b* and a fixed portion 24*a* and a movable portion 24*b* respectively, and the movable portion 23*b* of the first heat insulating member 23 is hingedly supported by the fixed portion 23*a* for movement as indicated at 50, so that the two movable members 23*b* and 24*b* can move as a uint with respect to the fixed portions 23*a* and 24*a*. In the embodiment shown, the side plates 25 are stationary and fixed in place. However, the heat insulating means 22 may be provided with side plates separate from the side plates of the fixing device 4 as a whole which are located on opposite sides thereof for movement along with the movable members 23*b* and 24*b*. The numerals 53 and 54 designate seals for providing a seal between the fixed portion 24*a* and movable portion 24*b* and between the fixed portion 23*a* and the movable portion 23*b* respectively. The seals 53 and 54 are formed of flexible material, such as sponge, which does not interfere with the movement of the movable portions 23*b* and 24*b***.

The stripping claw 9 descrived hereinabove is supported for movement by a movable member of the heat insulating means 22. In the embodiment shown, a bracket 60 is secured to either side of the movable member **23*b* of the first heat insulating member 23 for supporting a rod 61 which in turn supports at least one stripping claw 9 for movement. A tension spring 62 is connected at one end to the first heat insulating member 23 and the stripping claw 9 to bias the stripping claw 9 clockwise at all times. Thus, a forward end 9*a* of the stripping claw 9 is brought into contact with the heating roller 6 to perform the function of stripping a recording sheet off the heating roller. For biasing the stripping claw 9, any other suitable means than the tension spring 62** may be used without departing from the scope of the invention.

When a recording sheet is stuck between the forward end **9*a* of the stripping claw 9 and the peripheral surface of the heating roller 6, the unit 45 is withdrawn from the main body of the copying apparatus as described hereinabove, and the cover 49 for the inverting device 30 is brought to an open position as shown in FIG. 2. The operator grips a handle 51 attached to the movable portion 24*b* of the second heat insulating member and moves it upwardly, to thereby move the two movable members 23*b* and 24*b* as shown in FIG. 2. This moves the stripping claw 9 supported by the movable member 23*b* together with the movable portions 23*b* and 24*b*, so that the forward end 9*a* of the claw 9 is moved away from the heating roller 6 as shown in FIG. 2. This releases the recording sheet, not shown, stuck between the forward end 9a of the stripping claw 9 and the peripheral surface of the heating roller 6, and the operator is readily able to remove the released recording sheet from the fixing device 4 through a relatively large space below the stripping claw 9. The stripping claw 10 located below the claw 9 is released from engagement with the pressure applying roller 7 as the cover 49 or the movable portions 23b and 24b move, to enable a recording sheet stuck between the roller 7 and claw 10** to be readily released and removed.

When the movable portions 23b and 24b of the heat insulating means 22 moves, the forward end 9a of the stripping claw 9 which is sharp remains directed inwardly without being exposed to outside from the fixing device 4 because the stripping claw 9 is biased clockwise by the tension spring 62 as described hereinabove. Thus, there is essentially no risk of the operator being injured by the forward end 9a of the stripping claw 9.

If the angle at which the movable members 23b and 24b move is too great, then the heating roller 6 is exposed to outside from the fixing device 4. This might cause the operator to suffer burns when he might inadvertenely touch the heating roller 6 heated to a high temperature. To obviate this disadvantage, a first stopper 52 is attached to the side plate 25 as shown in FIG. 2 to allow a projection 63 of the movable portion 23b to be brought into abuting engagement therewith, to thereby restrict the range of movement of the movable members 23b and 24b. Thus, the movable portions 23b and 24b are prevented from moving beyond this range of movement. However, if the range of movement of the movable members 23b and 24b is too small, it would become difficult to remove the stuck recording sheet, and the range of movement of the movable members 23b and 24b should be set by taking this into consideration.

When the movable members 23b and 24b of the heat insulating means 20 are moved by the operator, his hand might touch the fixing device 4. However, since the second heat insulating member 24 is not heated to a high temperature, the disadvantage of the operator suffering burns is eliminated.

If the hand is released from the handle 51 when removal of the stuck recording sheet is finished, then the movable members 23b and 24b return to a closed position shown in FIG. 1 by their own weight. By allowing the movable members 23b and 24b to return to the closed position by their own weight, the trouble that the movable members 23b and 24b might remain in the open position because the operator might forget to close them would not occur. A positioning member 64 is firmly secured to a movable member of the main body of the copying apparatus as shown in FIG. 2. When the movable members 23b and 24b are returned to the closed position as shown in FIG. 1, the support shaft 61 of the stripping claw 9 is fitted in a recess of the positioning member 64 to correctly position the movable members 23b and 24b. A spring, not shown, for biasing the movable members 23b and 24b toward the closed position may be advantageously provided to enable them to be restored to the closed position positively.

When the movable members 23b and 24b are moved from the closed position to bring the forward end of the stripping claw 9 out of enganement with the heating roller 6, the stripping claw 9 is moved by the biasing force of the tension spring 62. However, if the stripping claw 9 is moved a large distance by the biasing force of the spring 62, the forward end 9a of the stripping claw 9 would interfere with resetting of the movable members 23b and 24b in the closed position when an attempt is made to do so, making it impossible to reset them in the closed position. To avoid this trouble, a second stopper 65 is attached to the movable member 23b of the first heat insulating member 23 for a projection 9b (see FIG. 2) of the stripping claw 9 to come into abutting engagement therewith when the movable portions 23b and 24b are moved to an open position, to thereby restrict the range of movement of the stripping claw 9 to obviate the disadvantage which might otherwise be caused by the movement of the stripping claw 9 over a large distance. By suitably selecting the position and/or shape of the stropper 65, it is possible to prevent the forward end 9a of the stripping claw 9 from being brought out of contact with the peripheral surface of the heating roller 6 when the movable portions 23b and 24b are brought to the open position.

In the embodiment shown and described hereinabove, the lower stripping claw 10 which is normally kept in contact with the pressure applying roller 7 is constructed such that when the movable portions 23b and 24b are moved from a closed position to an open position or the cover 49 is moved to an open position as shown in FIG. 2, the stripping claw 10 is released from contact with the pressure applying roller 7 conjointly with the movement of the aforesaid members, to allow a recording sheet stuck between the stripping claw 10 and pressure applying roller 7 to be removed therefrom. In this embodiment, the heating roller 6 and pressure applying roller 7 are released from engagement with each other not only when the copying apparatus is inoperative and standing by but also when the recording sheet stuck in the fixing device 4 is removed therefrom. Thus, removal of the recording sheet stuck in the fixing device 4 is facilitated.

Figure 3:
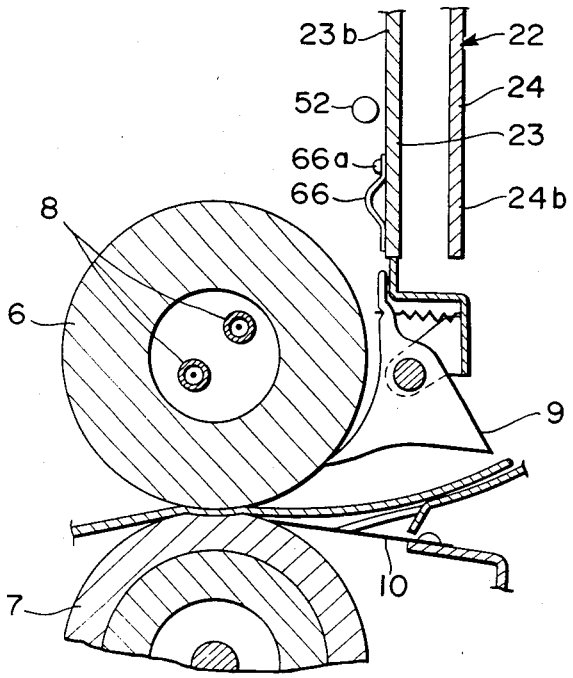
FIG. 3 is a view similar to FIG. 1 but showing another embodiment of the fixing device in conformity with the invention.
Figure 4:
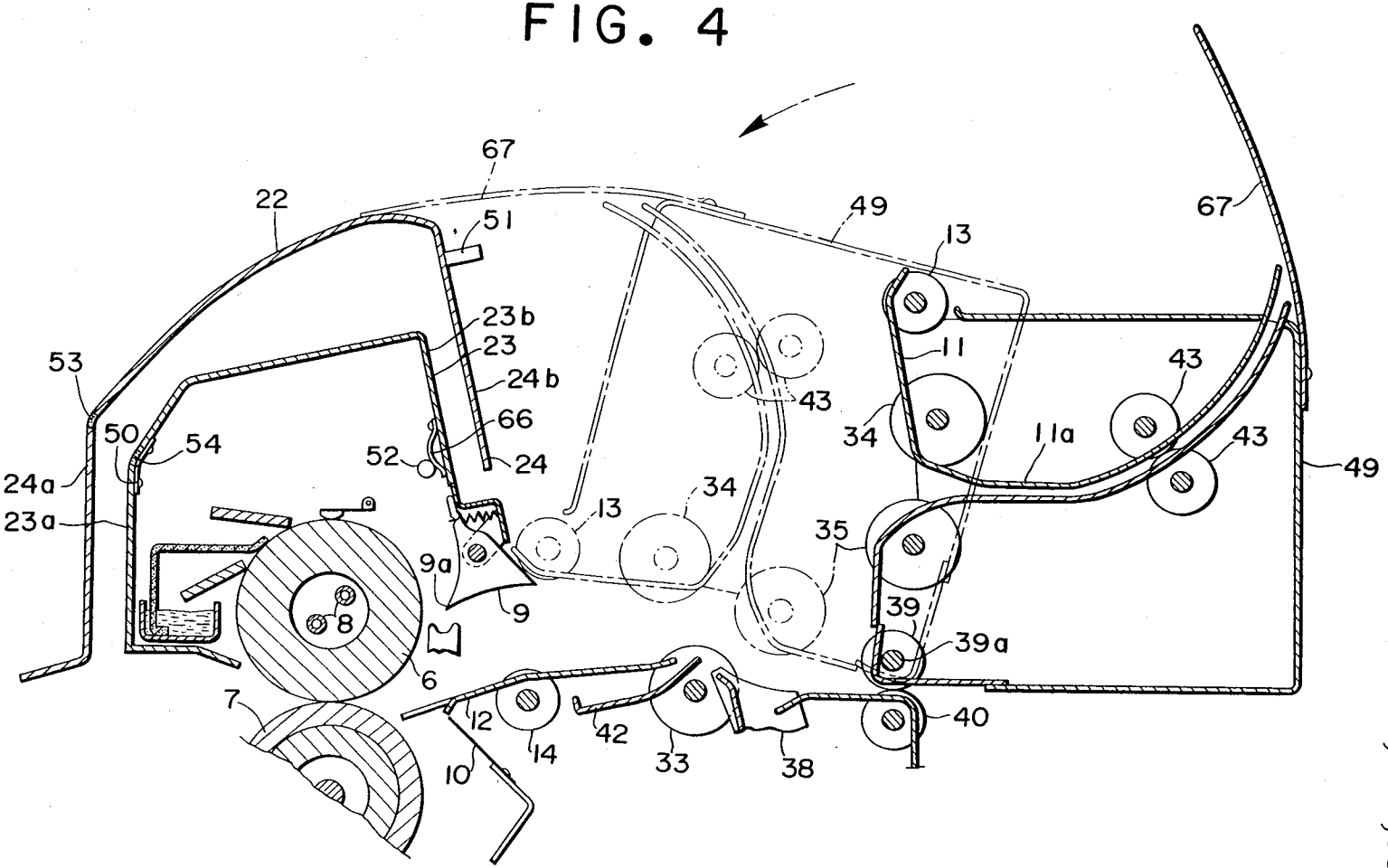
FIG. 4 is a view similar to FIG. 2 but showing the embodiment shown in FIG. 3.

In the embodiment shown in FIGS. 1 and 2, when it is desired to keep the movable portions 23b and 24b of the heat insulating means 22 in an open position, it is necessary to keep them in place as by hand. To obviate this disadvantage, a plate spring 66 is secured at one end 66a, in an embodiment shown in FIGS. 3 and 4, to the movable member 23b of the first heat insulating member 23 in place of the projection 63 shown in FIG. 1. When the movable portions 23b and 24b of the heat insulating means 22 are moved from the closed position shown in FIG. 3 to the open position shown in FIG. 4, the first stopper 52 which is fixed strikes the plate spring 66 and then moves over a central portion of the plate spring 66. By virtue of this feature, when the movable portions 23b and 24b are moved to a full-open position shown in FIG. 4, they are kept in the full-open position even if the hand is released from the handle 51 because the first stopper 52 is positioned against the central portion of the plate spring 66 which is protruding. When it is desired to return the movable portions 23b and 24b to a full-closed position one only has to move the movable portions 23b and 24b downwardly. This causes the stopper 52 to move over the plate spring 52 again by deforming it, to enable the movable portions 23b and 24b to be returned to the closed position shown in FIG. 3. To enable the heat insulating means 22 to be automatically reset, a pressing member 67 (see FIG. 4) is advantageously secured to the cover 49 and caused to strike the movable portion 24b when cover 49 is moved from a full-open position to a phantom line position shown in FIG. 4, to thereby automatically move the movable portion 24b to a full-closed position.

While preferred embodiments of the invention have been shown and described, it is to be understood that the invention can have application not only in the electrophotographic copying apparatus of the toner image transferprinting type but also in other type of copying apparatus or a recording apparatus. In the embodiments shown and described hereinabove, the heating roller is enclosed by the heat insulating means. The pressure applying roller may also be enclosed by means similar to the heat insulating means shown in the drawings. The provision of the heat insulating means to the pressure applying means is advantageous when the latter has built in heaters. The heat insulating means has been shown and described as having a double wall structure. It is not essential, however, that the heat insulating means have a double wall structure over is entire length, and the heat insulating means may have a double wall structure only locally, not over its entire length. Of course, the heat insulating means may have three or more wall structure. What is important is that the heat insulating means having a multiwall structure at least in one portion is arranged to enclose at least a portion of the heating roller and pressure applying roller. In place of drawing air by suction means from the air passage, the air in the air passage may be discharged from the air passage by causing the heating air in the air passage to flow spontaneously. In the embodiments shown and described hereinabove, only a portion (movabler portions) of the heat insulating means is rendered movable. However, the heat insulating means may be made to move in its entirety. The first and second stoppers may be of other type than that shown and described. Thus, the invention makes it possible to achieve better results in insulating the heat of the fixing device while minimizing the thermal loss.

From the foregoing description, it will be appreciated that the fixing device according to the invention comprising a heating roller and a pressure applying roller is provided with heat insulating means which is supported in a manner to allow a portion thereof to move freely, a first stopper for restricting the range of movement of the movable portion of the heat insulating means, at least one stripping claw movably supported by the movable portion of the heat insulating means, biasing means biasing the stripper claw in a direction in which a forward end of the stripper claw is brought into contact with the heating roller, and a second stopper for restricting the range of movement of the stripper claw. By virtue of these features, a recording sheet stuck between the heating roller and stripping claw is readily removed and the risk that the hand of the operator might be injured by contact with a sharp forward edge of the stripper claw is avoided. Also, the disadvantage that the operator might suffer burns from contact with the heating roller heated to a high temperature is avoided. Also, it is not necessary in the invention to provide the heat insulating means with a large cutout for withdrawing the stripper claw therethrough, as is the case with the prior art. Thus, the heat insulating means according to the invention can achive excellent heat insulating effects while offering the aforesaid various advantages.

What is claimed is:

1. A fixing device comprising:

a pair of fixing rollers including a heating roller and a pressure applying roller maintained in pressing engagement with each other to allow a toner image bearing recording sheet to pass therethrough;

at least one stripping claw having a forward end arranged such that said forward end is in contact with the heating roller to strip a recording sheet off the heating roller when the recording sheet adheres to the heating roller;

heat insulating means arranged in a manner to enclose at least a portion of the pair of fixing rollers, said heat insulating means including at least one portion movably supported by a fixed portion of said heat insulating means and supporting said stripper claw for movement;

a spring mounted between said heat insulating means and stripping claw for biasing a forward end of the stripper claw to press against the heating roller; and a stopper attached to the heat insulating means for restricting the range of movement of the stripper claw toward the heating roller.

2. A fixing device as claimed in claim 1, wherein the stopper for the stripping claw is so arranged that the forward end of the stripping claw is not exposed to outside from the fixing device at a time when said movable portion of said heat insulating means is moved fully and said stripping claw does not interferringly engage with the heating roller by resetting of the heat insulating means.

3. A fixing device as claimed in claim 1, wherein the maximum movement of said movable portion of said heat insulating means is so restricted that the heating roller is not exposed to outside from the fixing device in order to prevent an operator from being injured by touching the heating roller.

4. A fixing device as claimed in claim 1, wherein at least one of the position and the shape of the stopper is so selected that the forward end of the stripping claw is prevented from being brought out of contact with the peripheral surface of the heating roller at a time when the movable portion of the heat insulating means is brought to an open position.

5. A fixing device as claimed in claim 1, wherein said heat insulation means is arragned in a manner to enclose at least a portion of the pair of fixing rollers, said heat insulating means having a double wall structure in at least a portion thereof to define an air passage.

6. A fixing device as claimed in claim 5, wherein said heat insulating means comprises an air inlet of the air passage located on the entrance side of the pair of fixing rollers.

7. A fixing device as claimed in anyone of claims 5 or 6 heat insulating means comprises an air inlet of the air passage located on the exit side of the pair of fixing rollers.

* * * * *